United States Patent [19]

Lange

[11] Patent Number: 4,881,768

[45] Date of Patent: Nov. 21, 1989

[54] SECURITY DEVICE

[75] Inventor: Edwin L. Lange, Bull Creek, Australia

[73] Assignees: Kenneth G. Kavanagh, Cottesloe; Edward I. Kavanagh, Thornlie, both of Australia

[21] Appl. No.: 136,848

[22] Filed: Dec. 22, 1987

[30] Foreign Application Priority Data

Dec. 23, 1986 [AU] Australia ..... PH9655
Feb. 13, 1987 [AU] Australia ..... PI358

[51] Int. Cl.[4] ..... E05D 13/00

[52] U.S. Cl. ..... 292/251; 292/300; 292/DIG. 46

[58] Field of Search ..... 292/251, 300, DIG. 46; 70/95

[56] References Cited

U.S. PATENT DOCUMENTS

| | | | |
|---|---|---|---|
| 2,937,416 | 5/1960 | Hiers | 292/DIG. 46 X |
| 2,950,756 | 8/1960 | Moloney | 292/DIG. 46 X |
| 3,282,618 | 11/1966 | Adickes | 292/258 |
| 3,401,994 | 9/1968 | Diack | 70/95 X |
| 3,640,559 | 2/1972 | Royer | 292/DIG. 46 X |
| 3,714,738 | 2/1973 | Koslow | 49/404 |
| 3,745,708 | 7/1973 | Gullstan | 49/454 |
| 3,754,783 | 8/1973 | Childers | 292/263 |
| 3,975,041 | 8/1976 | Edison | 292/DIG. 46 X |
| 4,054,308 | 10/1977 | Prohaska | 292/DIG. 46 X |
| 4,062,576 | 12/1977 | Jennings et al. | 292/258 |
| 4,281,477 | 8/1981 | Kaminaga | 49/453 |
| 4,526,412 | 7/1985 | Gist | 292/300 |
| 4,630,853 | 12/1986 | Bell | 292/259 |

FOREIGN PATENT DOCUMENTS

| | | |
|---|---|---|
| 619592 | 3/1949 | United Kingdom . |
| 1270872 | 4/1972 | United Kingdom . |

*Primary Examiner*—Peter R. Brown
*Attorney, Agent, or Firm*—John S. Hale

[57] ABSTRACT

A security device for securing a sliding window or door in a sliding window or door and frame assembly. The security device is positioned at an upper region of the sliding window or door and frame assembly to prevent removal of the sliding window or door from the frame when such removal is attempted.

A method for securing a sliding window or door and frame assembly using such security device, along with a sliding window or door and frame assembly incorporated such a security device are also described.

4 Claims, 8 Drawing Sheets

SECURITY DEVICE

The present invention relates to a security device for a sliding window or door and frame assembly, a sliding window or door and frame assembly provided with a security device, a method of securing a sliding window or door in a sliding window or door and frame assembly and a method of instruction for securing a sliding window or door in a sliding window or door and frame assembly.

Various security means have been devised to prevent would-be intruders from gaining unauthorized access to buildings by interfering with conventional locking mechanisms on horizontally sliding window or door assemblies.

Such security means have been directed to prevent the window or door being slid horizontally in its frame, even if the locking mechanism is somehow interfered with and by-passed. However, such security means do not deal with the problem of preventing the sliding window or door being moved upwardly and maneuvered out of its frame.

The present invention addresses the latter problem.

In accordance with a first aspect of the present invention there is provided at least one security device for a sliding window or door and frame assembly arranged to be positioned at a location of said sliding window or door and frame assembly, wherein said sliding window or door is slidable in its respective said frame such that said security device prevents removal of said sliding window or door from its respective frame when removal thereof is attempted.

In accordance with a second aspect of the present invention there is provided a sliding window or door and frame assembly, said frame comprising upper and lower channels in which said sliding window or door is slidable, wherein said sliding window or door and frame assembly is provided with at least one security device positioned at a location of said sliding window or door and frame assembly such that said security device prevents removal of said sliding window or door from its respective frame when removal thereof is attempted.

In accordance with a third aspect of the present invention there is provided a method of securing a sliding window or door in its respective frame of a sliding window or door and frame assembly comprising positioning at least one security device at a location of said sliding window or door and frame assembly such that said sliding window or door is slidable in its respective frame and said security device prevents removal of said sliding window or door from its respective frame when removal thereof is attempted.

In accordance with a third aspect of the present invention there is provided a method of instruction for securing a sliding window or door in its respective frame of a sliding window or door and frame assembly comprising the instructional steps of positioning at least one security device at a location of said sliding window or door and frame assembly such that said sliding window or door is slidable in its respective said frame and said security device prevents removal of said sliding window or door from its respective frame when removal thereof is attempted. The present invention will hereinafter be described with particular reference to a sliding window and frame assembly. However, it will be understood that the present invention is of equal applicability to a sliding door and frame assembly.

The present invention will now be described, by way of example, with reference to the accompanying drawings, wherein:

FIG. 1 is a perspective view of a first embodiment of the present invention of a sliding window and frame assembly having a security device provided therein, with the sliding window in closed position;

FIG. 2 an elevation view of the first embodiment shown in FIG. 1;

Figure 5:
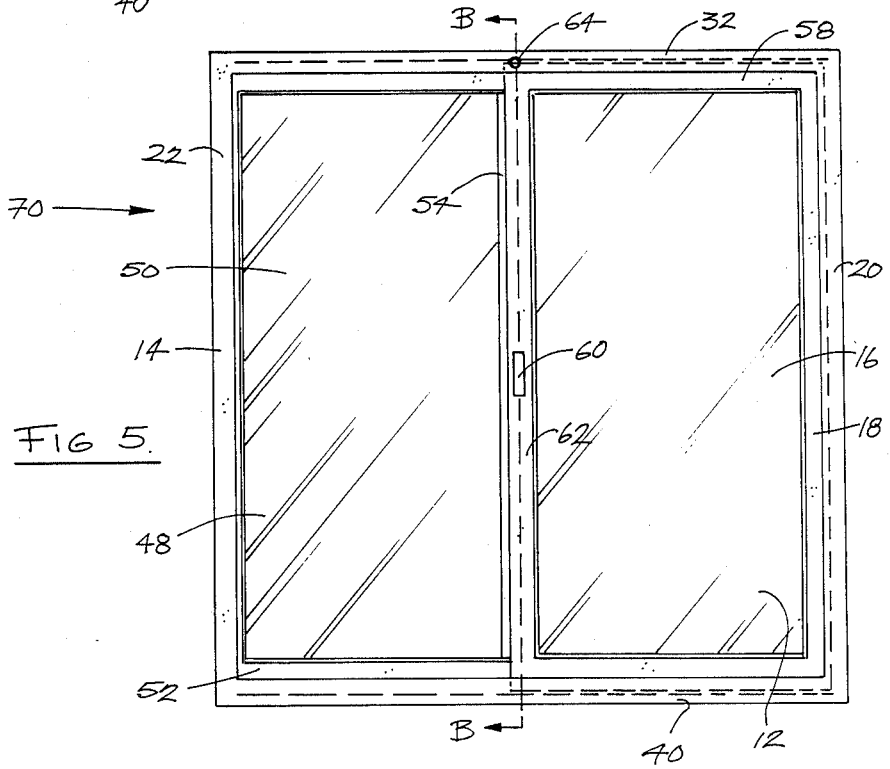
FIG. 5 is an elevation view of the second embodiment shown in FIG. 3.
Figure 6:
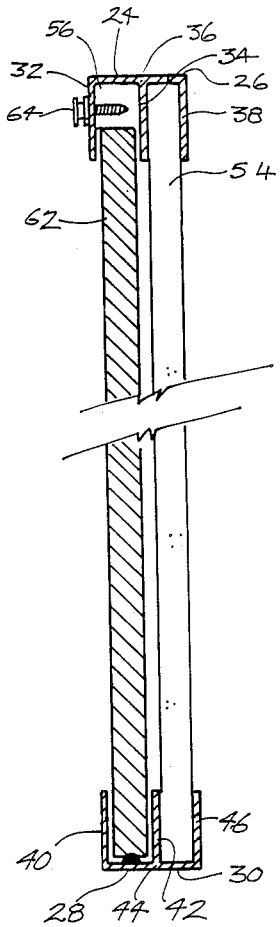
Figure 7:
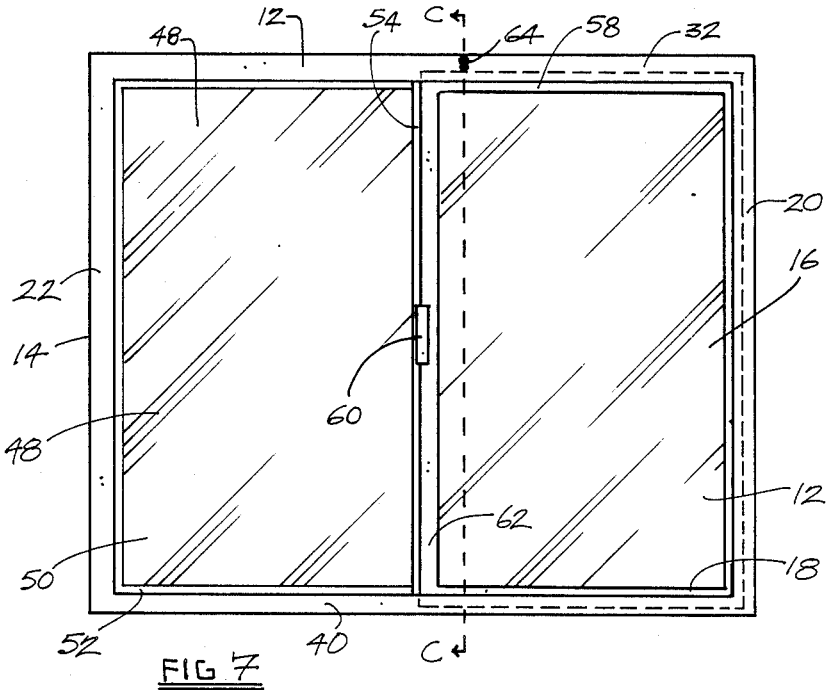
Figure 8:
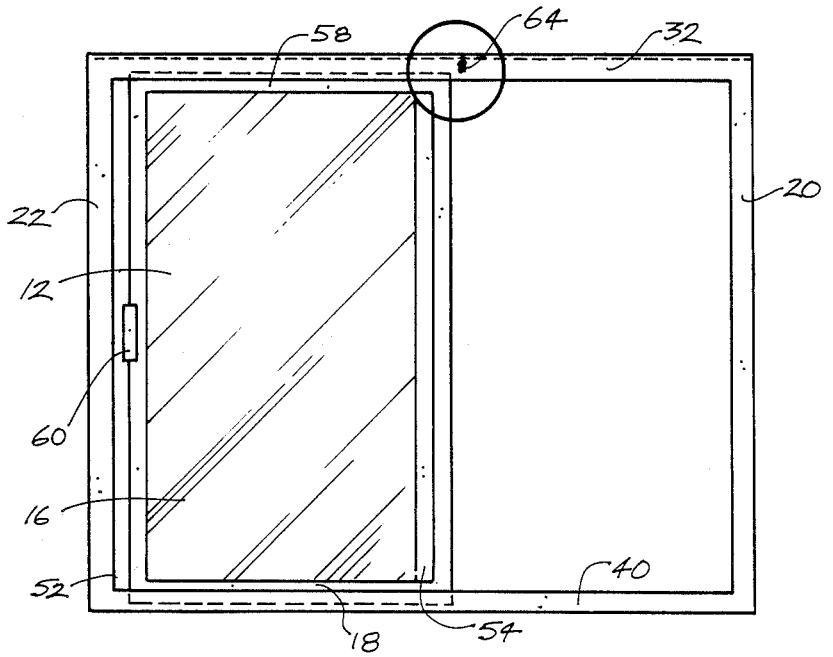
Figure 9:
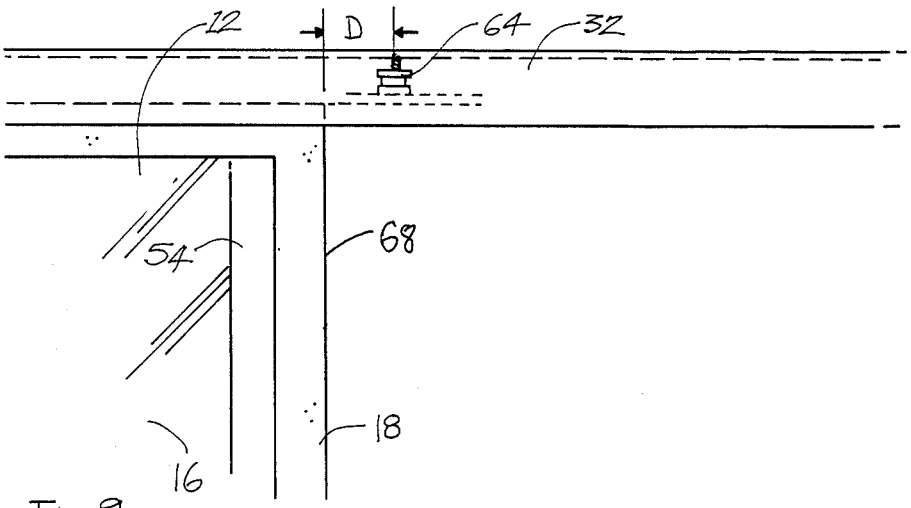
Figure 10:
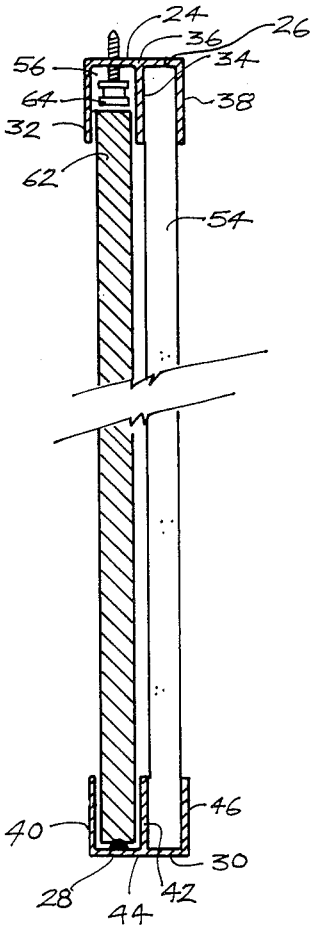
Figure 11:
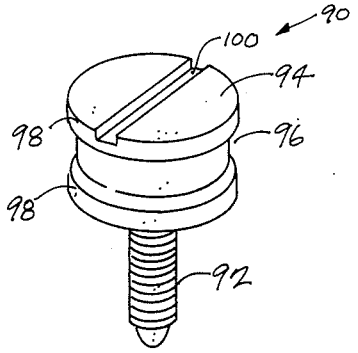
Figure 12:
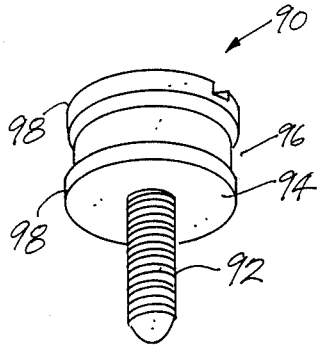
Figure 13:
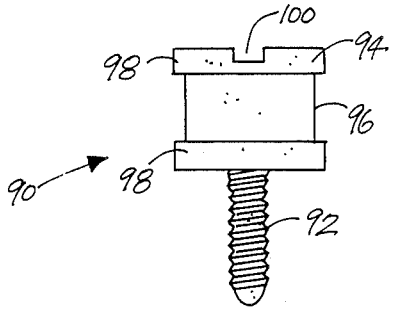
Figure 14A:
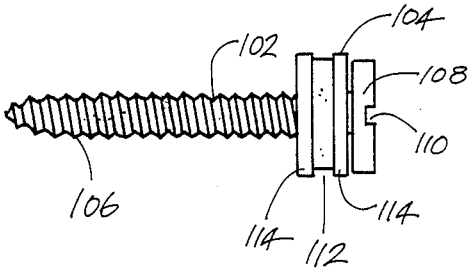
Figure 14B:
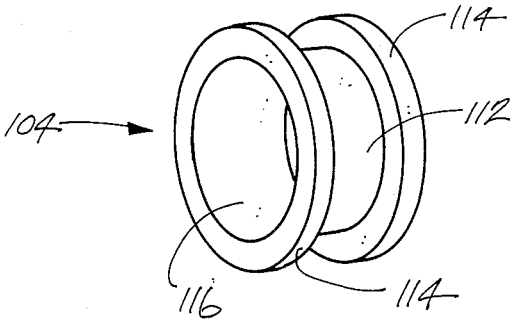

FIG. 6 a sectional view through the line B—B of FIG. 5;

FIG. 7 is an elevation view of a third embodiment of the present invention of a sliding window and frame assembly having a security device provided therein, with the sliding window in closed position;

FIG. 8 an elevation view of the third embodiment shown in FIG. 7, but with the sliding window in the fully open position;

FIG. 9 is a detail of the encircled portion of FIG. 8;

FIG. 10 is a sectional view through the line C—C of FIG. 7;

FIG. 11 is a first perspective view of a first embodiment of the security device in accordance with the present invention;

FIG. 12 is a second perspective view of the security device in FIG. 11;

FIG. 13 is an elevation view of the security device shown in FIG. 11;

FIG. 14*a* is an elevation view of a second embodiment of the security device in accordance with the present invention; and FIG. 14*b* is a perspective view of the collar of the security device shown in FIG. 14*a*.

Detailed Description of the Invention

Figure 1:
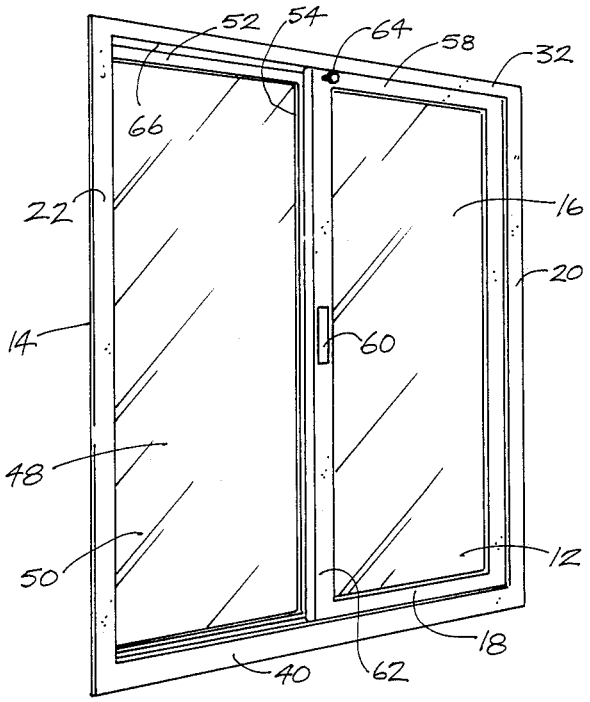
Figure 2:
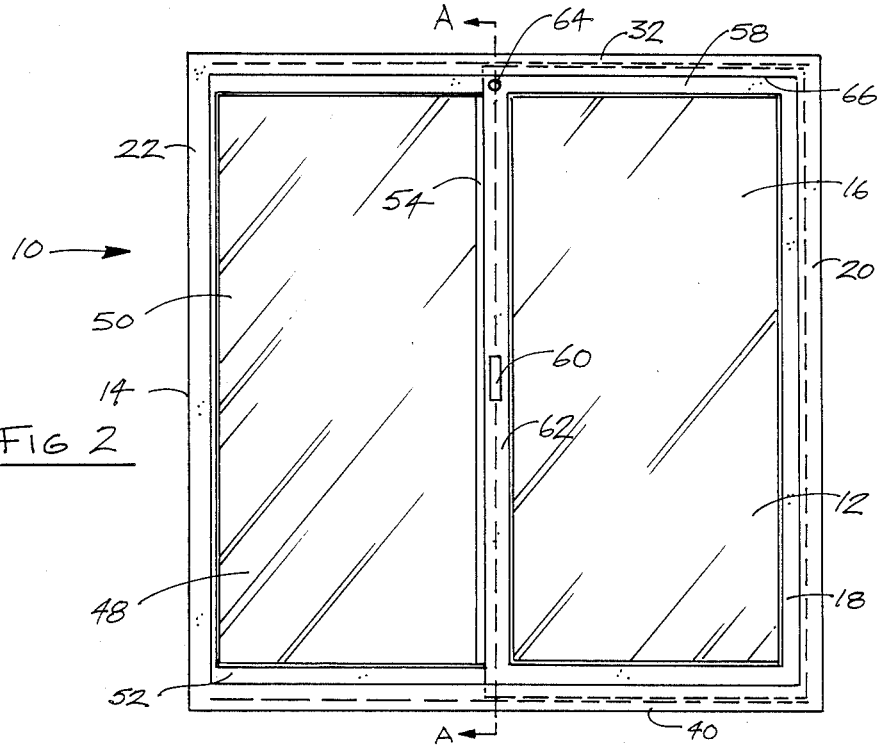

In FIGS. 1 and 2, there is shown a sliding window and frame assembly 10 comprising a sliding window 12 and frame 14.

The sliding window and frame assembly 10 may be fixed in a wall structure of a building with the views shown in FIGS. 1 and 2 being on the inside of the building.

The sliding window 12 comprises a glass pane 16 surrounded by a border-frame 18.

Figure 3:
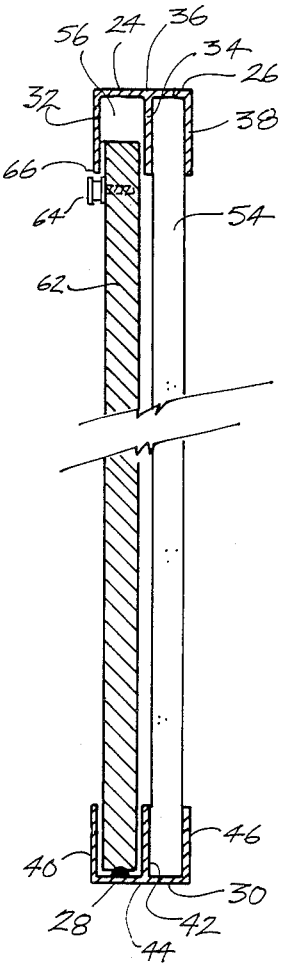
FIG. 3 is a sectional view through the line A—A of FIG. 2.

The frame 14 comprises channel means in which the sliding window 12 is slidable and side frame members 20 and 22. The channel means comprises a pair of upper channels 24 and 26 and a pair of lower channels 28 and 30. The upper channel 24 is formed by the outer depending portion 32 of the frame 14, the inner depending portion 34 of the frame 14 and part of the upper portion 36 of the frame 14. The upper channel 26 is formed by the outer depending portion 38 of the frame 14, the inner depending portion 34 of the frame 14 and part of the upper portion 36 of the frame 14. The lower channel 28 is formed by the outer upstanding portion 40 of the frame 14, the inner upstanding portion 42 of the frame 14 and part of the lower portion 44 of the frame 14. The lower channel 30 is formed by the outer upstanding portion 46 of the frame 14, the inner upstanding portion 42 of the frame 14 and part of the lower portion 44 of the frame 14. A fixed window 48 is contained in the frame 14. The fixed window 48 comprises a glass pane 50 surrounded by a border-frame 52. The border-frame 52 of the fixed window 48 is fixed in the side frame member 22 and the upper channel 26 and lower channel 30. Thus, only an upright portion 54 of the border-frame 52 remains unfixed. This is best seen in FIGS. 2 and 3.

The sliding window 12 is slidable in the upper channel 24 and lower channel 28.

A gap 56 exists between the top of the upper portion 58 of the border-frame 18 and the roof of channel 24. This is best seen in FIG. 3.

The border-frame 18 of the sliding window 12 is provided with a handle 60 which also acts as a locking mechanism, when the sliding window 12 is in its closed position, by engaging with the unfixed upright portion 54 of the border-frame 52. The handle 60 is provided on the upright portion 62 of the border-frame 18.

The sliding window and frame assembly 10 further comprises a safety device in the form of a stop 64.

The stop 64 is mounted in or on the upper portion 58 of the border-frame 18 such that it projects from the surface of the upper portion 58 past the lower edge 66 of the outer depending portion 32. This is best seen in FIG. 3. Preferably, the stop 64 is mounted in or on the upper portion 58, above the upright portion 62 of the border-frame 18, and as close as possible to the lower edge 66 of the outer depending portion 32. A small clearance is provided between the top of the stop 64 and the lower edge 66 of the outer depending portion 32 to allow the sliding window 12 to slide freely in the upper channel 24 and the lower channel 28.

However, the stop 64 may be mounted at any location along the length of the upper portion 58.

The manner of operation of the sliding window and frame assembly 10 shown in FIGS. 1 to 3 will now be described. The sliding window 12 is able to slide in the upper channel 24 and lower channel 28 of the frame 14 in conventional manner.

However, due to the presence of the stop 64 in the sliding window and frame assembly 10, it is not possible to remove the sliding window 12 from the frame 14.

This is because, if the sliding window 12 is to be removed from the frame 14, the upper portion 58 must first be moved upwardly into the gap 56 to expose the bottom of the border-frame 18 from the lower channel 28. However, any upward movement of the sliding window 12 causes the stop 64 to engage the lower edge 66 of the outer depending portion 32 of the frame 14. Such engagement prevents any further upward movement of the sliding window 12.

Figure 4:
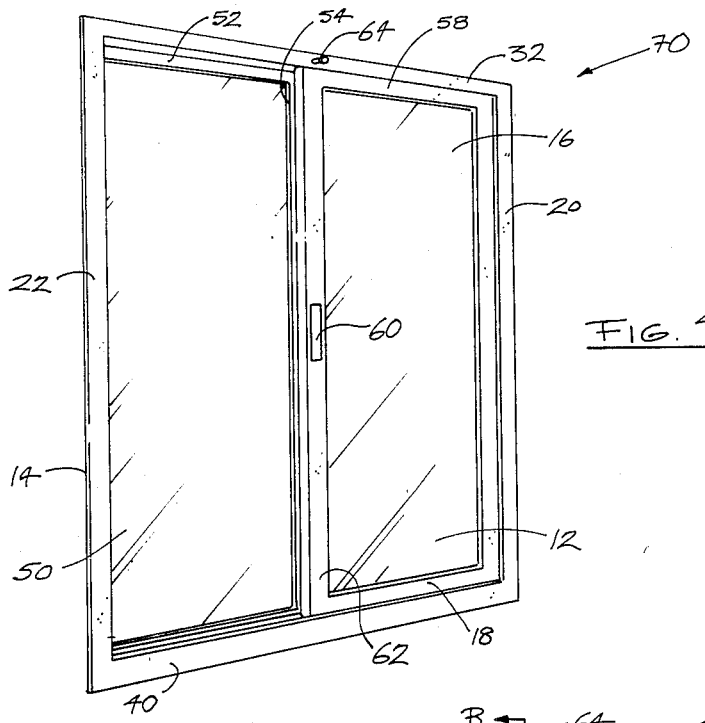
FIG. 4 is a perspective view of a second embodiment of the present invention of a sliding window and frame assembly having a security device provided therein, with the sliding window in the closed position.

Thus, removal of the sliding window 12 from the frame 14 is prevented since the bottom of the frame 14 cannot be exposed from the lower channel 28 since the stop 64 prevents the upper portion 58 being moved upwardly into the gaps 56. In FIGS. 4 to 6, there is shown a sliding window and frame assembly 70. The sliding window and frame assembly 70 is identical to the sliding window and frame assembly 10 shown in FIGS. 1 to 3, except for the location of the stop 64. Accordingly, the same reference numbers are used in FIGS. 4 to 6, as are used in FIGS. 1 to 3, to identify the same components.

The preceding description of the sliding window and frame assembly 10 applies equally to the sliding window and frame assembly 70, except in relation to the location of the stop 64. Such description shall not be here repeated, but the different location of the stop 64 in the sliding window and frame assembly 70 will be now described.

The sliding window and frame assembly 70 further comprises a safety device in the form of a stop 64.

The stop 64 is mounted in or on the outer depending portion 32 of the frame 14 such that it extends into the gap 56 in the upper channel 24, above the top of the upper portion 58 of the border-frame 18. This is best seen in FIG. 6. Preferably, the stop 64 is mounted in or on the outer depending portion 32 above the upright portion 62 of the border-frame 18, when the sliding window is in the closed position, and as close as possible to the top of the upper portion 58 of the border frame 18. A small clearance is provided between the top of the upper portion 58 of the border-frame 18 and the bottom of the stop 64 to allow the sliding window 12 to slide freely in the upper channel 24 and the lower channel 28.

However, the stop 64 may be mounted at any location along the length of the outer depending portion 32 that is above the upper portion 58 of the border-frame 18 when the sliding window 12 is in the closed position.

The manner of operation of the sliding window and frame assembly 70 shown in FIGS. 4 to 6 will now be described.

The sliding window 12 is able to slide in the upper channel 24 and lower channel 28 of the frame 14 in conventional manner.

However, due to the presence of the stop 64 in the sliding window and frame assembly 70, it is not possible to remove the sliding window 12 from the frame 14.

This is because, if the sliding window 12 is to be removed from the frame 14, the upper portion 58 must first be moved upwardly into the gap 56 to expose the bottom of the border-frame 18 from the lower channel 28. However, any upward movement of the sliding window 12 causes the top of the upper portion 58 of the border frame 18 to engage the portion of the stop 64 that extends into the gap 56 in the upper channel 24, above the top of the upper portion 58. Such engagement prevents any further upward movement of the sliding window 12.

Thus, removal of the sliding window 12 from the frame 14 is prevented since the bottom of the frame 14 cannot be exposed from the lower channel 28 since the stop 64 prevents the upper portion 58 being moved upwardly into the gap 56.

In FIGS. 7 to 10, there is shown a sliding window and frame assembly 80. The sliding window and frame assembly 80 is identical to the sliding window and frame assembly 10 shown in FIGS. 1 to 3, except for the location of the stop 64. Accordingly, the same reference numbers are used in FIGS. 7 to 10 to identify the same components.

The preceding description of the sliding window and frame assembly 10 applies equally to the sliding window and frame assembly 80, except in relation to the location of the stop 64. Such description shall not be here repeated, but the different location of the stop 64 in the sliding window and frame assembly 80 will now be described.

The sliding window and frame assembly 80 further comprises a safety device in the form of a stop 64.

The stop 64 is mounted in or o the roof of the upper channel 24 such that it extends into the gap 56 in the upper channel 24 above the top of the upper portion 58 of the border-frame 18. This is best seen in FIG. 10. Preferably, the stop 64 is mounted in the roof of the upper channel 24 such that the horizontal distance D between the edge 68 of the border-frame 18 and the stop 64, when the sliding window is in the fully open position, is approximately 20mm. A distance D of this length allows sufficient clearance to permit the sliding window 12 to be installed in, or removed from, the frame 14 when the sliding window is in the open position. The stop 64 is mounted in the roof of the upper channel 24 as close as possible to the top of the upper portion. A small clearance is provided between the top of the upper portion 58 of the border-frame 18 and the stop 64 to allow the sliding window 12 to slide freely in the upper channel 24 and lower channel 28. However, the stop 64 may be mounted at any location along the length of the roof of the upper channel 24 that is above the upper portion 58 of the border-frame 18 when the sliding window 12 is in the closed position.

The manner of operation of the sliding window and frame assembly 80 will now be described.

The sliding window 12 is able to slide in the upper channel 24 and lower channel 28 in conventional manner.

When it is desired to remove the sliding window 12 from the frame 14, the sliding window is first slid into the open position such that the edge 68 of the border-frame 18 has passed the stop 64 as shown in FIGS. 8 and 9.

The sliding window 12 may then be removed from the frame 14 by moving the upper portion 58 upwardly into the gap 56 to expose the bottom of the frame 14 from the lower channel 28. However, due to the presence of the stop 64 in the sliding window and frame assembly 80, it is not possible to remove the sliding window 12 from the frame 14 when the upper portion 58 is beneath the stop 64.

This is because, if the sliding window 12 is to be removed from the frame 14, the upper portion 58 must first be moved upwardly into the gap 56 to expose the bottom of the border-frame 18 from the lower channel 28. However, when the sliding window 12 is in the closed position, any such upward movement of the sliding window 12 causes the top of the upper portion 58 of the border-frame 18 to engage the stop 64 in the gap 56 in the upper channel 24. Such engagement prevents any further upward movement of the sliding window 12.

Thus, removal of the sliding window 12 from the frame 14 is prevented, when the sliding window 12 is in the closed position, since the bottom of the border-frame 18 cannot be exposed from the lower channel 28 since the stop 64 prevents the upper portion 58 being moved upwardly into the gap 56. The security device may comprise stop means in the form of a projecting member.

Accordingly, the security device may be in the form of a screw of suitable size.

In the first embodiment, shown in FIGS. 1 to 3, such a screw could be located in position by first drilling a hole, at the desired location, in the upper portion 58 of the border-frame 18 and then inserting the screw into the drilled hole.

In the second embodiment, shown in FIGS. 4 to 6, such a screw could be located in position by first drilling a hole, at the desired location, in the outer depending portion 32 of the frame 14 and then inserting the screw into the drilled hole.

In the third embodiment, shown in FIGS. 7 to 10 such a screw could be located in position by first drilling a hole, at the desired location, in the roof of the upper channel 24 and then inserting the screw into the drilled hole. When the screw is located at the position shown in FIGS. 7 to 10, a distance D of 20mm allows sufficient clearance for a drill to be used to drill a hole in the roof of the upper channel 24.

In each of the above embodiments the screw is inserted into the hole to the extent required.

The security device may be in the form of a screw 90 as shown in FIGS. 11 to 13.

In FIGS. 11 to 13 there is shown a security device in the form of a screw 90 comprising a threaded shaft 92 and a head 94.

The head 94 is provided with a circumferential groove 96 formed between two flange ends 98.

A slit 100 is formed in the head 94 to accommodate a screw driver.

When the screw 90 is used as the stop 64 in the first embodiment shown in FIGS. 1 to 3, the groove 96 engages with the lower edge 66 of the outer depending portion 32 when the sliding window 12 is attempted to be moved upwardly in the frame 14. The groove 96 thus provides a secure engagement between the lower edge 66 and the screw 90.

A second embodiment of the security device is shown in FIGS. 14*a* and 14*b*.

In FIGS. 14*a* and 14*b* there is shown a security device in the form of a screw 102 and collar 104.

The screw 102 comprises a threaded shaft 106 and a head 108. A slit 110 is formed in the head 108 to accommodate a screwdriver.

The collar 104 is provided with a circumferential groove 112 formed between two flange ends 114 and a central bore 116. The collar 104 can pass over the threaded shaft 106 of the screw 102 via the bore 116.

The groove 112 of the collar 104 operates in a similar manner to the groove 96 of the security device shown in FIGS. 11 to 13, in relation to its operation in the first embodiment shown in FIGS. 1 to 3.

While two embodiments of the security device have been described with reference to FIGS. 11 to 13 and FIGS. 14*a* and 14*b*, respectively, the form of the security device is not to be considered as being restricted to these. The security device may be of any suitable form which, when positioned in a sliding window or door and frame assembly, prevents the window or door from being removed from its respective frame at least when the window or door is in the closed position.

The security device may be mounted on or in the sliding window or door and frame assembly by any suitable method, e.g. by adhesive, welding or forming the security device integral with the sliding window or door and frame assembly during the manufacturing stage, along with the method of inserting it into a drilled hole as hereinbefore described. While the preceding description of the embodiments has described the use of only a single security device in each embodiment, it will be understood that any desired number may be used. With most situations two security devices, positioned apart from one another, on the top portion 58 of the border-frame 18, outer depending portion 32 and/or inside the upper channel 24, as the case may be, are found satisfactory.

The present invention may be used in conjunction with a length of dowel, or the like, placed in the channel lower channel 28, adjacent the fixed window 48, when the sliding window 12 is in the closed position. The dowel would be of a length such that it substantially abuts the edge of the upright portion 62 of the border-frame 18 and the internal edge of the side frame member 22 when it is placed in the lower channel 28.

The dowel, or the like, prevents the sliding window 12 being slid in the frame 12 when the sliding window 12 is in the closed position, even if the locking mechanism of the handle 60 is interfered with or otherwise non-operative.

The dowel, or the like, may be employed in a similar manner in a sliding door and frame assembly.

The present invention prevents the window or door being removed from the frame of a sliding window or door and frame assembly.

Thus, combining the two systems provides added security to a sliding window or door and frame assembly.

Modifications and variations such a would be apparent to a skilled addressee are deemed within the scope of the present invention.

I claim:

1. A security device for a sliding window or door and frame assembly, said sliding window or door including a border-frame around its periphery and being slidable to assume an open and a closed position in said frame assembly, said frame assembly defining upper and lower channel means in which said sliding window or door is slidable, said upper channel means comprising an outer depending portion, an inner depending portion and an upper frame portion, said security device comprising:

a projecting member having a shaft, a head located at one end of said shaft defining a circumferential groove so that when said security device is affixed to the front face of said border-frame of said sliding window or door beneath the edge of said outer depending portion said security device projects outwardly from said border-frame with said circumferential groove positioned adjacent to the lower edge of said outer depending portion of said upper channel means to prevent removal of said sliding window or door from said frame assembly.

2. A security device for a sliding window or door and frame assembly in accordance with claim 1, wherein said security device is affixed to said border-frame so that it is positioned near the corner of said border-frame which is nearest the mid region of said sliding window or door and frame assembly when said sliding window or door is in said closed position.

3. A security device for a sliding window or door and frame assembly, said sliding window or door including a border-frame around its periphery and being slidable to assume an open and a closed position in said frame assembly, said frame assembly comprising upper and lower channel means in which said sliding window or door is slidable, said upper channel means comprising an outer depending portion, an inner depending portion and an upper frame portion, said security device comprising: a projecting member having a shaft, a head located at one end of said shaft and a collar arranged to pass over said shaft and abut said head, said collar defining a circumferential groove so that when said security device is affixed to the front face of said border-frame of said sliding window or door beneath the edge of said outer depending portion said security device projects outwardly from said border-frame with said circumferential groove positioned adjacent to the lower edge of said outer depending portion of said upper channel means to prevent removal of said sliding window or door from said frame assembly.

4. A security device for a sliding window or door and frame assembly in accordance with claim 3, wherein said security device is affixed to said border-frame so that it is positioned near the corner of said border-frame which is nearest the mid region of the sliding window or door and frame assembly when said sliding window or door is in a closed position.

* * * * *